US006139288A

United States Patent [19]

Karasawa

[11] Patent Number: 6,139,288

[45] Date of Patent: Oct. 31, 2000

[54] HIGH PRESSURE PUMP

[75] Inventor: Yukihiko Karasawa, Ohmiya, Japan

[73] Assignee: Karasawa Fine Co., Ltd., Ohmiya, Japan

[21] Appl. No.: 09/171,092

[22] PCT Filed: Feb. 16, 1998

[86] PCT No.: PCT/JP98/00618

§ 371 Date: Oct. 13, 1998

§ 102(e) Date: Oct. 13, 1998

[87] PCT Pub. No.: WO98/36172

PCT Pub. Date: Aug. 20, 1998

[30] Foreign Application Priority Data

Feb. 14, 1997 [JP] Japan ..... 9-030124

[51] Int. Cl.[7] ..... F04B 17/03; H02K 7/06

[52] U.S. Cl. ..... 417/415; 415/534; 92/31; 92/136; 310/68 B; 310/83

[58] Field of Search ..... 417/415, 534, 417/521; 92/136, 31, 32, 33; 310/80, 83, 68 B

[56] References Cited

U.S. PATENT DOCUMENTS

| | | | |
|---|---|---|---|
| 2,482,464 | 9/1949 | Chapman | 310/83 |
| 4,145,165 | 3/1979 | Perkins et al. | 417/418 |
| 4,276,003 | 6/1981 | Perkins et al. | 417/415 |
| 5,557,154 | 9/1996 | Erhart | 310/80 |

*Primary Examiner*—Andrew M. Dolinar
*Attorney, Agent, or Firm*—Armstrong, Westerman, Hattori, McLeland & Naughton

[57] ABSTRACT

The present invention provides a high pressure pump (1), which comprises an electric motor (2) having a through-hole in axial direction on a rotation shaft (5), a thrust transmission shaft (8) engaged with threads of a rotation nut (6) operated by rotation of the motor, passing through the through-hole and performing linear reciprocal movement, plungers (9*a*, 9*b*) performing reciprocal movement in cylinders and connected to at least one end of the thrust transmission shaft (8), and a stress-strain sensor (16) provided on at least one of the plunger or the thrust transmission shaft.

3 Claims, 2 Drawing Sheets

HIGH PRESSURE PUMP

FIELD OF THE INVENTION

The present invention relates to a high pressure pump for pressurizing fluid at high pressure, and in particular to a high pressure pump, which contributes to energy-saving and space-saving and also can generate pressure at a predetermined pressure value from low pressure to high pressure and ensures operation at high reliability.

BACKGROUND ART

Various types of pumps are used to pressurize fluid at high pressure. As a driving source for these high pressure pumps, motor-driven system, hydraulic booster system, pneumatic booster system, etc. are known.

A representative example of direct-coupled motor type system is a three-throw plunger pump as commonly used. In this type of pump, it is necessary to mount a large speed reducing gear on crankshaft for the control of number of revolutions and for increasing output of the motor. Even in such case, it is difficult to reduce the speed to less than 400 rpm, and upper pressure limit is about 1500 kgf/cm$^2$. From the reason of mechanism, it is impossible to eliminate liquid trap, and it is practically impossible to perform processing of different liquid phases by a single pump. Also, in case high pressure circuit is closed from some reason, pressure may be infinitely increased, and this means that it is necessary to provide a safety valve and to frequently confirm its reliability.

In the hydraulic booster system, hydraulic pump is operated by an electric motor, and a booster pump based on Pascal's principle is driven by the hydraulic pressure to obtain the high pressure as required. However, the system itself must be designed in large size because hydraulic pump, hydraulic valve, hydraulic tank, etc. are required. Also, energy efficiency is decreased because electric energy is converted to hydraulic pressure by motor and hydraulic pump, and this energy is used. Further, it is not possible to perform pressure control below the level of "the lowest hydraulic pressure generated x booster ratio". Because oil temperature is varied due to the change of ambient temperature, fine adjustment of hydraulic pressure must be carried out.

In the pneumatic pressure booster system, the required pressure is attained by driving a booster pump by compressed air based on Pascal's principle. In general, however, pneumatic pressure of 10 kgf/cm$^2$ is used because of restriction by high pressure gas law. Therefore, in case it is wanted to attain high pressure, e.g. in case it is wanted to attain the pressure of 2000 kgf/cm$^2$, booster ratio must be 200-fold. Because higher booster ratio is required, a large quantity of air is needed, and this means that a very large air compressor must be provided. Also, a dryer must be arranged because moisture components contained in the air must be removed, and this leads to still larger size of the system. Because it is not possible to reduce the pressure below the level of booster ratio in this case, even when this pump is operated at the lowest pressure of 0.5 kgf/cm$^2$, it is not possible to operate at 100 kgf/cm$^2$ or less. Because electric energy is converted to pneumatic pressure by motor and air compressor and this energy is utilized, the energy efficiency is low.

As described above, none of the conventional type high pressure pumps used for the purpose of pressurizing fluid at high pressure meets the requirements such as lightweight and compact design, improvement of energy efficiency, accuracy of the generated pressure in the required pressure range from low pressure to high pressure, or high reliability operation.

DISCLOSURE OF THE INVENTION

It is an object of the present invention to provide a high pressure pump, by which it is possible to attain the effects of energy-saving and space-saving and to provide accurate pressure and high reliability operation in the generation of the required pressure range from low pressure to super-high pressure, and also to provide reliable instantaneous stop function when high pressure circuit is closed.

The high pressure pump according to the present invention comprises plungers, a motor having a through-hole running in axial direction of rotation shaft, and a thrust transmission shaft engaged with threads of rotation nuts operated by rotation of the motor and passing through the through-hole and performing reciprocal movement, whereby a plunger performing reciprocal movement in a cylinder is connected to at least one end of the thrust transmission shaft.

The invention also provides the high pressure pump as described above, wherein a booster mechanism comprising an eccentric differential gear is arranged between rotation shaft of the motor and the rotation nut.

The invention further provides the high pressure pump as described above, wherein a stress-strain sensor is arranged at least on one of the plungers and the thrust transmission shaft.

The invention still further provides the high pressure pump as described above, wherein a plunger is connected to each end of the thrust transmission shaft.

BEST MODE FOR CARRYING OUT THE INVENTION

In the following, description will be given on the present invention referring to the attached drawings.

Figure 1:
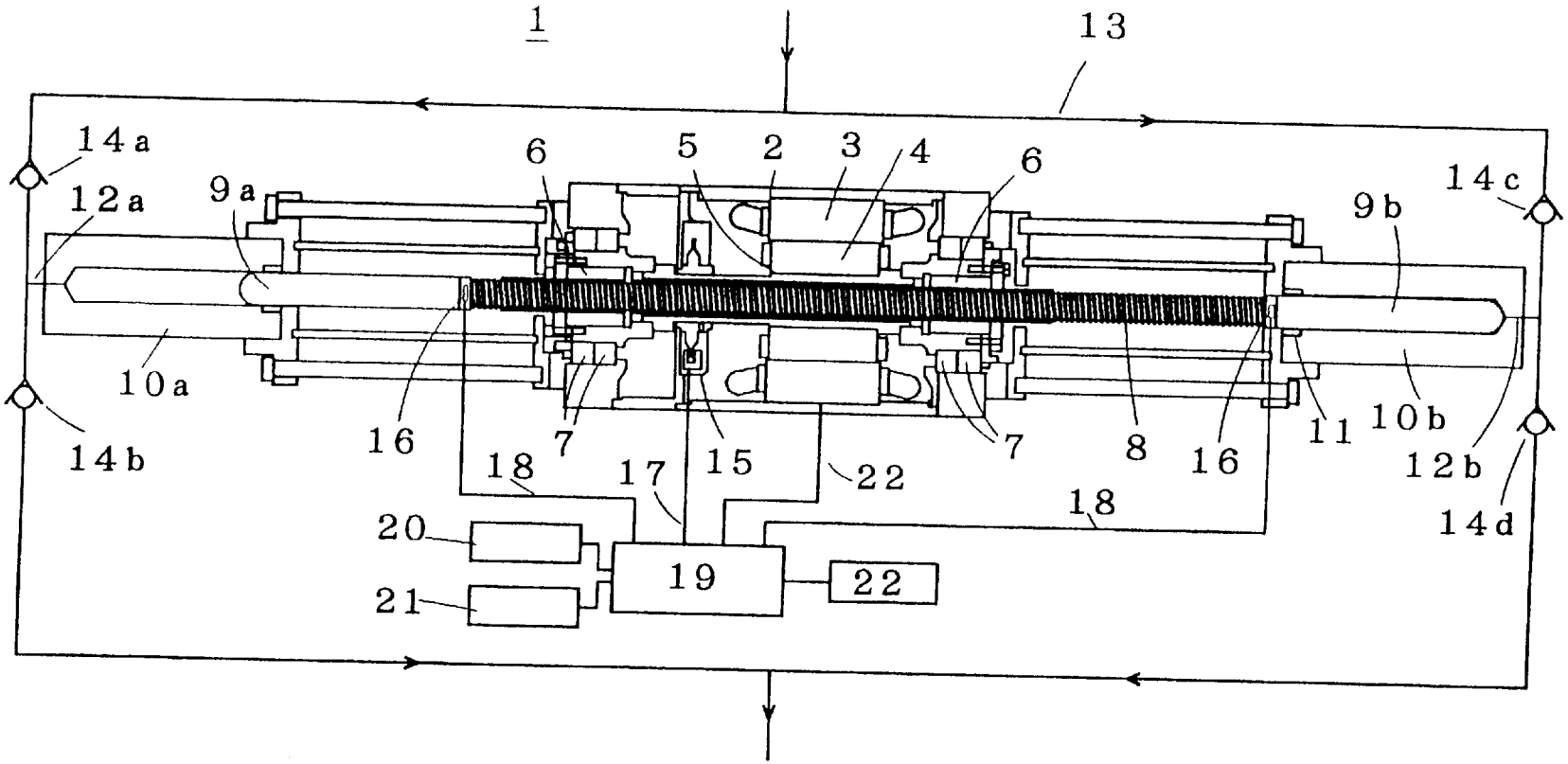
FIG. 1 is a cross-sectional view of an embodiment of a high pressure pump according to the present invention.

FIG. 1 is a cross-sectional view of an embodiment of a high pressure pump according to the present invention.

A high pressure pump 1 of the present invention is provided with an electric motor 2 for driving plungers, and a rotor 4 arranged opposite to a stator 3 of the motor is connected to a rotation shaft 5, which has a through-hole in the direction of the rotation shaft at its center. On the rotation shaft, rotation nuts 6 are connected, and these nuts are mounted via balls 7.

A thrust transmission shaft 8 is engaged with threads of the rotation nuts 6 and is reciprocally moved by rotation of the rotation nuts 6 and passes through the rotation shaft. On the thrust transmission shaft, a splunger 9*a* is connected to one end and a plunger 9*b* is connected to the other end. By changing rotating direction of the motor, the thrust transmission shaft 8 performs reciprocal movement.

When the plunger 9*a* is moved leftward in the figure into a cylinder 10*a*, fluid is pressurized, and two check valves 14*a* arranged on a fluid channel 13 are operated to close the fluid channel, and the fluid in the cylinder is pressurized and flows out to the fluid channel via a flow passage 12*a* and a check valve 14*b*. On the other hand, when the plunger 9*b* is moved leftward in a cylinder 10*b*, a check valve 14*d* is closed while a check valve 14*c* is opened. Thus, the fluid is sucked through a flow passage 12*b*.

When rotating direction of the motor is reversed, the thrust transmission shaft is moved in reverse direction, and the plungers 9*a* and 9*b* are operated-reversely. In the system shown in FIG. 1, plungers and cylinders are provided on both ends of the thrust transmission shaft, and the fluid can be continuously pressurized.

An encoder 15 for detecting number of revolutions and other values is provided on the motor, and a stress-strain sensor 16 is mounted on screw shaft, and a rotating speed signal 17 and a strain signal 18 are sent to a controller 19. Based on the rotating speed signal 17, the strain signal 18, a signal from an input unit 20, and data stored in a memory 21, the controller 22 issues a motor adjusting signal 22 so that a predetermined pressure is generated in the high pressure pump. Further, various types of information relating to operation of the high pressure pump are displayed on a display unit 23.

In the system of the present invention, a stress-strain sensor is fixed in the thrust transmission shaft. In combination with the encoder, it performs pressure control at very high accuracy, and there is no need to connect a pressure detector in the high pressure fluid channel. In a hydraulically driven system, pressure applied on the fluid is pulsated due to pressure variation caused by changes of hydraulic pressure over time, and this means that pressure compensation is required. In the system of the present invention where the stress-strain sensor and the encoder are provided, the pressure can be adjusted at high accuracy. Further, when the fluid is replaced with other type of fluid, the previously used fluid does not remain in any portion of the fluid channel, and this means that there is no possibility of contamination by the remaining fluid component.

When the fluid channel is closed by failure, operation can be instantaneously stopped by these sensors.

In the high pressure pump of the present invention, cylinders are mounted at the ends of the driving units of the plungers, and this facilitates the replacement of the cylinders and the maintenance of the system.

In the system shown in FIG. 1, a plunger of 12.7 mm in diameter and with stroke of 146 mm was used, and a nozzle of 0.1 mm in diameter was mounted on high pressure output side. Water was used as fluid, and motor was rotated to push the plunger thoroughly in 4 seconds. Then, rotation of the motor was reversed and reciprocal movement was performed. As a result, pressure of 2000 kgf/cm$^2$ was attained. On both ends of the thrust transmission shaft, a high pressure unit with the same plunger and the cylinder is connected. Therefore, discharge under pressure output of 2000 kgf/cm$^2$ is 15 strokes/min., and discharge rate per stroke is about 19.5 ml. Thus, discharge for one minute is 277 ml.

In the system of the present embodiment, a motor with output of 5.5 kW was used. The system was 900 mm in overall length, 210 mm in maximum diameter, and 60 kg in total weight. Required power was 1.2 kW, and power transmission efficiency reached 75%.

As described above, in the system of the present invention, it is possible to attain power transmission efficiency by about 50% higher than that of the hydraulically driven system. The required power is about ⅓ of the pneumatically driven system. Installation space requirement is about 1/10 of that of the hydraulically driven system and about 1/20 of that of the pneumatically driven system.

Figure 2:
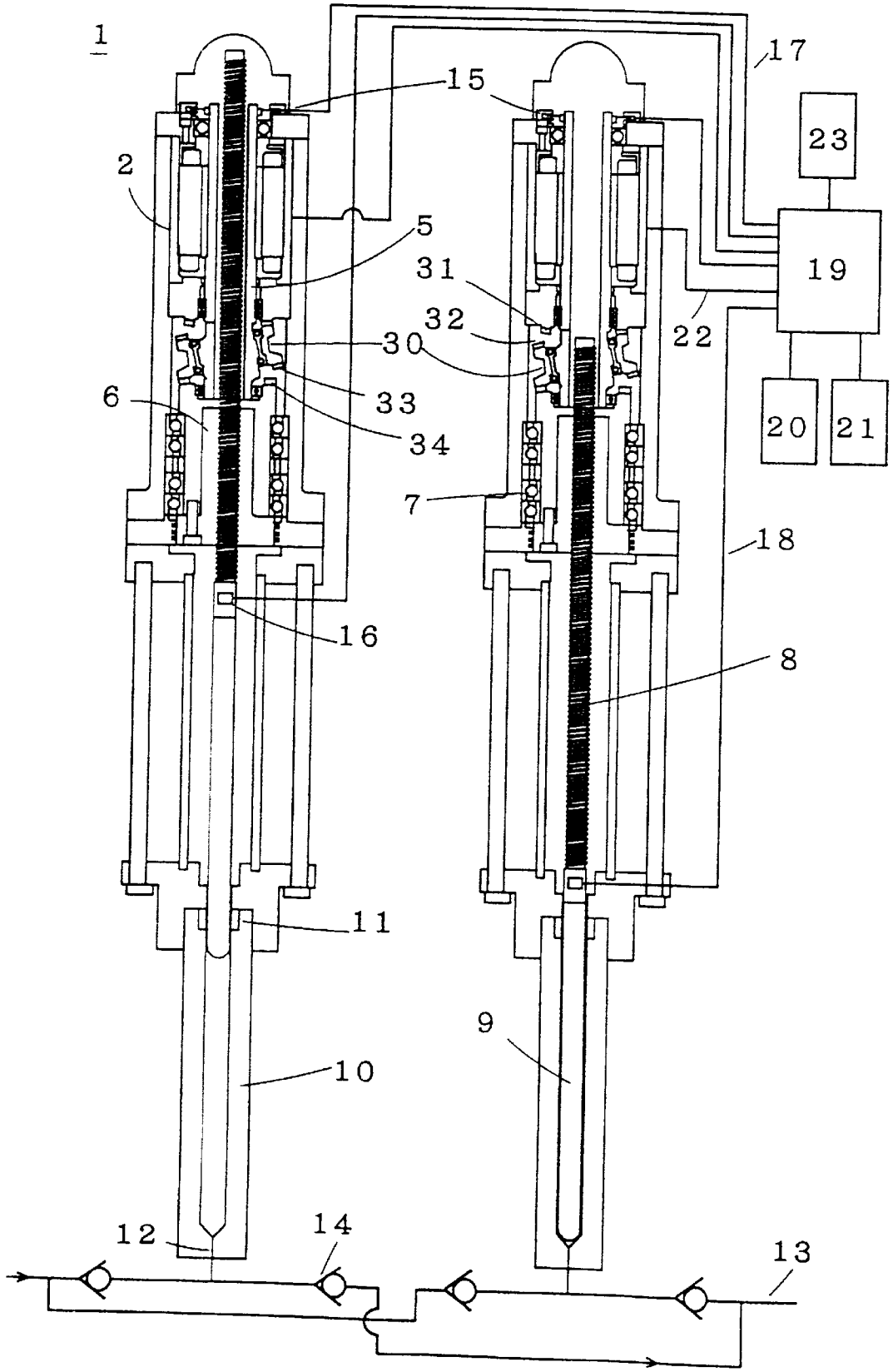
FIG. 2 shows another embodiment of the high pressure pump of the present invention.

FIG. 2 shows another embodiment of the high pressure pump of the present invention.

In the system shown in FIG. 2, fluid is pressurized using two vertical type high pressure pumps each provided with a plunger only on one end.

A high pressure pump 1 is provided with a motor 2 for driving plungers, and a rotator 4 arranged opposite to a stator 3 of the motor is connected to a rotation shaft 5, which has a through-hole concentric to the central rotation shaft. On lower end of the rotation shaft, rotation nuts 6 are mounted via an eccentric differential gear 30, and the rotation nuts are mounted via balls 7. A fixed gear 31 of the eccentric differential gear mounted on one end of the rotation shaft is engaged with a Coriolis gear 32 on input side of the eccentric differential gear. From a Coriolis gear 33 on output side of the eccentric differential gear, rotating force is transmitted to an output gear 34 of the eccentric differential gear connected to the rotation nut 6. Thus, pressure can be boosted for the rotation of the motor.

In the through-hole of the rotation shaft, a thrust transmission shaft 8 passes through, which performs reciprocal movement when rotating direction of the rotation nut 6 is changed. A plunger 9 is connected to the lower end of the thrust transmission shaft, and the plunger 9 enters the cylinder 10 to pressurize the fluid. A seal 11 is provided on the cylinder to prevent leakage of the fluid. The cylinder is connected to a portion between two check valves 14 on a fluid channel 13 via a flow passage 12 where the fluid flows in or out. By operation of the two check valves, the fluid is sucked or pressurized. An encoder 15 for detecting number of revolutions and other values is arranged on the motor, and a stress-strain sensor 16 is mounted on screw shaft. Thus, a rotating speed signal 17 and a strain signal 18 are sent to a controller 19. Based on the rotating speed signal 17, the strain signal 18, a signal sent from an input unit 20, and data stored in a memory 21, the controller issues a motor adjusting signal 22 to adjust high pressure pump so that a predetermined pressure is generated in the high pressure pump. Various types of information relating to operation of the high pressure pump is displayed on a display unit 23.

When rotating direction of the motor and number of revolutions are adjusted in such manner that one of the plungers is at the uppermost position while the other plunger is at the lowermost position, and when one of the plungers performs pressurizing operation, the other plunger performs suction operation. As a result, the fluid can be continuously pressurized.

In the system shown in FIG. 2, an eccentric differential gear of 10:1 was arranged between the rotation shaft of the motor and the rotation nut, and a high pressure plunger of 50 mm in diameter and with stroke of 410 mm was used. A nozzle of 0.8 mm in diameter was mounted on high pressure output side, and water was used as fluid. When pressurizing was performed at 2000 kgf/cm$^2$, discharge of 16.7 liters/min. was attained. In this operation, number of rotations was 10.4 rpm for each pump.

In contrast, in a hydraulically driven system, power of 75 kW or more is required to obtain output of 1000 liters/hour at 2000 kfg/cm$^2$. In the system of the present invention, the power required is 27.5 kW, and this is about ⅓ of the hydraulically driven system. Also, in case of the pneumatically driven system, it is not possible to attain the pump of the same capacity.

INDUSTRIAL APPLICABILITY

In the pump according to the present invention, rotation of the motor is changed to reciprocal movement of the thrust transmission shaft mounted in the rotation shaft, and plungers are connected to the thrust transmission shaft. Thus, the pump can be designed in compact size. Because the stress-strain sensor is provided in the thrust transmission shaft, pressure control at very high accuracy can be achieved by strain signal from the stress-strain sensor and by rotation signal from the encoder. Thus, there is no need to provide a pressure detector in the high pressure fluid channel. Even when the fluid is replaced with other type of fluid, the previously used fluid does not remain in the channel, and there is no possibility of contamination by the remaining fluid component. Further, a cylinder is mounted at the end of the driving unit of the plunger, and this facilitates replacement of the cylinder and the maintenance of the system.

What is claimed is:

1. A high pressure pump, comprising plungers, a motor having a through-hole running in an axial direction of a rotation shaft, and a thrust transmission shaft engaged with threads of rotation nuts operated by rotation of the motor and passing through the through-hole and performing reciprocal movement, whereby a plunger performing reciprocal movement in a cylinder is connected to at least one end of the thrust transmission shaft, and a booster mechanism comprising an eccentric differential gear is arranged between the rotation shaft of the motor and one of the rotation nuts.

2. A high pressure pump, comprising plungers, a motor having a through-hole running in an axial direction of a rotation shaft, and a thrust transmission shaft engaged with threads of rotation nuts operated by rotation of the motor and passing through the through-hole and performing reciprocal movement, whereby a plunger performing reciprocal movement in a cylinder is connected to at least one end of the thrust transmission shaft, and a stress-strain sensor is provided on at least one of the plunger or the trust transmission shaft.

3. A high pressure pump, comprising plungers, a motor having a through-hole running in an axial direction of a rotation shaft, and a thrust transmission shaft engaged with threads of rotation nuts operated by rotation of the motor and passing through the through-hole and performing reciprocal movement, whereby a plunger performing reciprocal movement in a cylinder is connected to at least one end of the thrust transmission shaft, a booster mechanism comprising an eccentric differential gear is arranged between the rotation shaft of the motor and one of the rotation nuts, and a stress-strain sensor is provided on at least one of the plunger or the trust transmission shaft.

* * * * *